US011284670B2

(12) United States Patent
Iuchi et al.

(10) Patent No.: US 11,284,670 B2
(45) Date of Patent: Mar. 29, 2022

(54) MIDSOLE STRUCTURE FOR A SHOE

(71) Applicant: Mizuno Corporation, Osaka (JP)

(72) Inventors: Kazunori Iuchi, Suita (JP); Shin Hirai, Himeji (JP); Takao Oda, Takarazuka (JP)

(73) Assignee: Mizuno Corporation, Osaka (JP)

( * ) Notice: Subject to any disclaimer, the term of this patent is extended or adjusted under 35 U.S.C. 154(b) by 241 days.

(21) Appl. No.: 16/286,892

(22) Filed: Feb. 27, 2019

(65) Prior Publication Data

US 2019/0289961 A1 Sep. 26, 2019

(30) Foreign Application Priority Data

Mar. 22, 2018 (JP) ..... JP2018-053985

(51) Int. Cl.
*A43B 13/18* (2006.01)
*A43B 13/22* (2006.01)
*A43B 13/12* (2006.01)

(52) U.S. Cl.
CPC ..... *A43B 13/186* (2013.01); *A43B 13/127* (2013.01); *A43B 13/185* (2013.01); *A43B 13/188* (2013.01); *A43B 13/223* (2013.01)

(58) Field of Classification Search
CPC ... A43B 13/186; A43B 13/223; A43B 13/188; A43B 13/185; A43B 13/127; A43B 13/026; A43B 13/187
See application file for complete search history.

(56) References Cited

U.S. PATENT DOCUMENTS 6,205,681 B1 * 3/2001 Kita ..... A43B 13/026 36/27
6,219,939 B1 * 4/2001 Kita ..... A43B 13/12 36/25 R (Continued)

FOREIGN PATENT DOCUMENTS

JP 11-346803 A 12/1999
JP 2001-231603 A 8/2001

(Continued)

OTHER PUBLICATIONS

Japanese Office Action in Japanese Patent Application No. 2018-053985, dated Jan. 17, 2020, 3 pages, with partial English translation, 3 pages.

(Continued)

*Primary Examiner* — Shaun R Hurley
*Assistant Examiner* — Bao-Thieu L Nguyen
(74) *Attorney, Agent, or Firm* — W. F. Fasse

(57) ABSTRACT

A midsole structure of a shoe includes an upper midsole, a lower midsole disposed below the upper midsole, and a wavy sheet interposed between the upper midsole and the lower midsole. The wavy sheet has a wavy shape at its medial and lateral side edge portions and a planar area at its central portion. The lower surface of the upper midsole and the upper surface of the lower midsole have wavy shapes that correspond to the wavy shape of the wavy sheet at their medial and lateral side edge portions and have a planar area that corresponds to the planar area of the wavy sheet at their central portions. The lower surface of the upper midsole and the upper surface of the lower midsole have a plurality of recesses that are disposed in the longitudinal direction at their central portions.

18 Claims, 16 Drawing Sheets

(56) References Cited

U.S. PATENT DOCUMENTS

| | | | | |
|---|---|---|---|---|
| 6,289,608 | B1 * | 9/2001 | Kita | A43B 13/026 36/28 |
| 6,311,414 | B1 * | 11/2001 | Kita | A43B 13/026 36/25 R |
| 6,314,664 | B1 * | 11/2001 | Kita | A43B 13/12 36/28 |
| 6,389,713 | B1 * | 5/2002 | Kita | A43B 13/026 36/28 |
| 6,393,732 | B1 | 5/2002 | Kita | |
| 6,516,539 | B2 * | 2/2003 | Nishiwaki | A43B 7/1465 36/28 |
| 6,625,905 | B2 * | 9/2003 | Kita | A43B 13/12 36/25 R |
| 6,647,645 | B2 * | 11/2003 | Kita | A43B 13/12 36/103 |
| 7,162,815 | B2 * | 1/2007 | Miyauchi | A43B 13/181 36/103 |
| 10,470,521 | B2 * | 11/2019 | Iuchi | A43B 13/185 |
| 10,631,591 | B2 * | 4/2020 | Chambers | A43B 13/141 |
| 2002/0014022 | A1 * | 2/2002 | Kita | A43B 13/18 36/28 |
| 2003/0000108 | A1 * | 1/2003 | Kita | A43B 13/186 36/28 |
| 2003/0000109 | A1 * | 1/2003 | Kita | A43B 13/186 36/30 R |
| 2010/0307028 | A1 * | 12/2010 | Teteriatnikov | A43B 13/145 36/108 |
| 2016/0029741 | A1 * | 2/2016 | Foxen | A43B 13/188 36/103 |
| 2017/0325543 | A1 | 11/2017 | Iuchi et al. | |
| 2018/0092431 | A1 * | 4/2018 | Iuchi | A43B 13/125 |
| 2018/0338568 | A1 * | 11/2018 | Chambers | A43B 3/0057 |
| 2019/0216169 | A1 * | 7/2019 | Yahata | A43B 13/18 |
| 2020/0046068 | A1 * | 2/2020 | Choi | A43B 13/127 |
| 2020/0305543 | A1 * | 10/2020 | Kajiwara | A43B 13/183 |

FOREIGN PATENT DOCUMENTS

| | | | |
|---|---|---|---|
| JP | 3238129 | B2 | 12/2001 |
| JP | 2017-202094 | A | 11/2017 |

OTHER PUBLICATIONS

Partial English translation of JP 2017-202094, Nov. 16, 2017.

* cited by examiner

MIDSOLE STRUCTURE FOR A SHOE

BACKGROUND OF THE INVENTION

The present invention relates generally to a midsole structure for a shoe, and more particularly, to the midsole structure that can not only secure landing stability of a heel portion but also further improve cushioning properties of a heel central portion and control bending direction.

The applicant of the present application proposed a midsole structure for a shoe such as shown in Japanese patent application publication No. 2017-202094 (hereinafter called JP '094). The midsole structure disclosed in JP '094 includes an upper midsole that extends from a heel region to a forefoot region, a lower midsole that is disposed below the upper midsole in the heel portion, and a thin sheet-like member that is disposed between the upper midsole and the lower midsole, that has a pair of wavy shaped portions on medial and lateral sides thereof and that has a planar portion at a central portion thereof (see FIGS. 2 to 4 in JP '094). Each of mating surfaces of the upper and lower midsoles has a wavy shaped portion and a planar portion that respectively correspond to the wavy shaped portion and the planar portion of the sheet-like member.

In such a midsole structure described in JP '094, when a shoe wearer impacts the ground on his/her heel, the wavy shaped portions disposed on the medial and lateral sides of the sheet-like member restricts a sinking movement of the medial and lateral sides of the upper and lower midsoles and thus prevents the heel portion of the upper and lower midsoles from deforming sideways. Thereby, the heel portion of a foot can be restricted from leaning to the medial and lateral sides to secure landing stability. Also, the central portion of the sheet-like member has a planar shape without a wavy shape, thus securing cushioning properties.

The applicant of the present application also proposed a midsole structure of a shoe such as shown in Japanese patent publication No. 3238129 (hereinafter called JP '129). The midsole structure disclosed in JP '129 includes an upper midsole disposed on an upper side of a heel region, a lower midsole disposed on a lower side of the heel region, and a wavy sheet disposed between the upper midsole and the lower midsole and having a wavy shape at an entire heel region (see FIGS. 1 to 3 in JP '129).

In such a midsole structure described in JP '129, when a shoe wearer impacts the ground on his/her heel, the wavy shaped portions disposed on the entire heel region of the wavy sheet restricts a sinking movement of the heel region of the upper and lower midsoles and thus prevents the heel region of the upper and lower midsoles from deforming sideways. Thereby, the heel portion of a foot can be further restricted from leaning to the medial and lateral sides to secure further landing stability. Also, the structure of JP '129 has a lateral cushioning hole formed thereinto at a contact area of the upper and lower midsoles with the wavy sheet thus enhancing cushioning properties at the time of a heel impact.

However, in the structure of JP '094, since the heel central portion of the sheet-like member is planar in shape, cushioning properties can be secured, but a load guidance function of the heel central portion during load travel at the time of impacting the ground is inadequate. Also, in the structure of JP '129, although the wavy shape formed at the heel central portion of the wavy sheet performs a load guidance function, the wavy shape at the heel central portion restricts cushioning properties of the heel central portion. Additionally, in the structure of JP '129, cushioning holes provided at the heel central portion are adapted to improve cushioning properties, but there exists a demand for a still further improvement of cushioning properties.

The present invention has been made in view of these circumstances and its object is to provide a midsole structure for a shoe that can not only secure landing stability of the heel region but also further improve cushioning properties of the heel central portion and control bending direction.

Other objects and advantages of the present invention will be obvious and appear hereinafter.

SUMMARY OF THE INVENTION

A midsole structure for a shoe according to the present invention includes an upper midsole disposed on an upper side of a heel region that corresponds to a heel portion of a foot of a shoe wearer, a lower midsole disposed below the upper midsole, and a wavy sheet interposed between the upper midsole and the lower midsole. The wavy sheet has a wavy shape at least either one of a sheet medial side portion or a sheet lateral side portion and has a planar shape at a sheet central portion. A lower surface of the upper midsole and an upper surface of the lower midsole have a wavy shape that corresponds to the wavy shape of the wavy sheet at least either at a sole medial side portion or at a sole lateral side portion. The lower surface of the upper midsole and the upper surface of the lower midsole have a planar shape that corresponds to the planar shape of the wavy sheet at a sole central portion. At least either the lower surface of the upper midsole or the upper surface of the lower midsole has a plurality of recesses disposed along a substantially longitudinal direction at the sole central portion.

According to the present invention, as above-mentioned, the wavy sheet has the wavy shape at least at either the sheet medial side portion or the sheet lateral side portion (that is, at one or both of the sheet medial side portion and the sheet lateral side portion), and the lower surface of the upper midsole and the upper surface of the lower midsole have wavy shapes that respectively correspond to the wavy shape of the wavy sheet at least at either the sole medial side or the sole lateral side (that is, at one or both of the sole medial side and the sole lateral side). Therefore, when a shoe wearer impacts the ground on his/her heel, the wavy shape disposed on the sheet medial/lateral side of the wavy sheet restricts a sinking movement of the sole medial/lateral side of the upper/lower midsole and thus prevents the heel region of the upper and lower midsoles from deforming sideways. Thereby, the heel portion of the foot can be restricted from leaning to the medial and lateral sides to secure landing stability. Also, the sheet central portion of the wavy sheet has a planar shape without a wavy shape, thus securing cushioning properties of the heel central portion.

Moreover, according to the present invention, since the sole central portion of at least either the lower surface of the upper midsole or the upper surface of the lower midsole has a plurality of recesses that extend substantially longitudinally, those recesses function as cushioning holes thus improving cushioning properties of the heel central portion.

Furthermore, according to the present invention, when a load travels at the time of impacting the ground, the plurality of recesses at the sole central portion on the lower surface of the upper midsole and/or the upper surface of the lower midsole exhibit a load guiding function at the heel central portion, such that thereby controlling a bending direction at the heel central portion.

The sole central portion of at least either the lower surface of the upper midsole or the upper surface of the lower midsole may have a wavy shape formed by the plurality of recesses.

The sole central portion of either the lower surface of the upper midsole or the upper surface of the lower midsole may have a plurality of recesses.

The sole central portion of both the lower surface of the upper midsole and the upper surface of the lower midsole may have a plurality of recesses.

The plurality of recesses of the sole central portion of the lower surface of the upper midsole may be vertically aligned with the plurality of recesses of the sole central portion of the upper surface of the lower midsole.

The plurality of recesses of the sole central portion of the lower surface of the upper midsole and the plurality of recesses of the sole central portion of the upper surface of the lower midsole may not be vertically aligned with each other and are deviated longitudinally, and both of the plurality of recesses may form wavy shapes.

The bottom portions of the plurality of recesses on at least either the lower surface of the upper midsole or the upper surface of the lower midsole may have trough lines extending substantially laterally.

The trough lines of the plurality of recesses may angle relative to the lateral direction.

The sheet central portion of the wavy sheet may have a through hole formed thereinto.

As explained above, in accordance with the present invention, when impacting the ground, the wavy shape on the sheet medial/lateral side of the wavy sheet can restrict a sinking movement of the sole medial/lateral side of the upper/lower midsole, thus preventing the heel region of the upper and lower midsoles from deforming sideways. Thereby, the heel portion of the foot can be restricted from leaning to the medial and lateral sides to secure landing stability. Also, the planar shape of the sheet central portion of the wavy sheet can secure cushioning properties of the heel central portion. Moreover, the plurality of recesses extending substantially longitudinally of the sole central portion of the lower surface of the upper midsole and/or the upper surface of the lower midsole can function as cushioning holes, thus improving cushioning properties of the heel central portion. Furthermore, the plurality of recesses at the sole central portion on the lower surface of the upper midsole and/or the upper surface of the lower midsole can exhibit a load guiding function at the heel central portion, such that thereby controlling a bending direction at the heel central portion.

BRIEF DESCRIPTION OF THE DRAWINGS

For a more complete understanding of the invention, reference should be made to the embodiments illustrated in greater detail in the accompanying drawings and described below by way of examples of the invention.

DETAILED DESCRIPTION OF THE PREFERRED EMBODIMENTS

Figure 1:
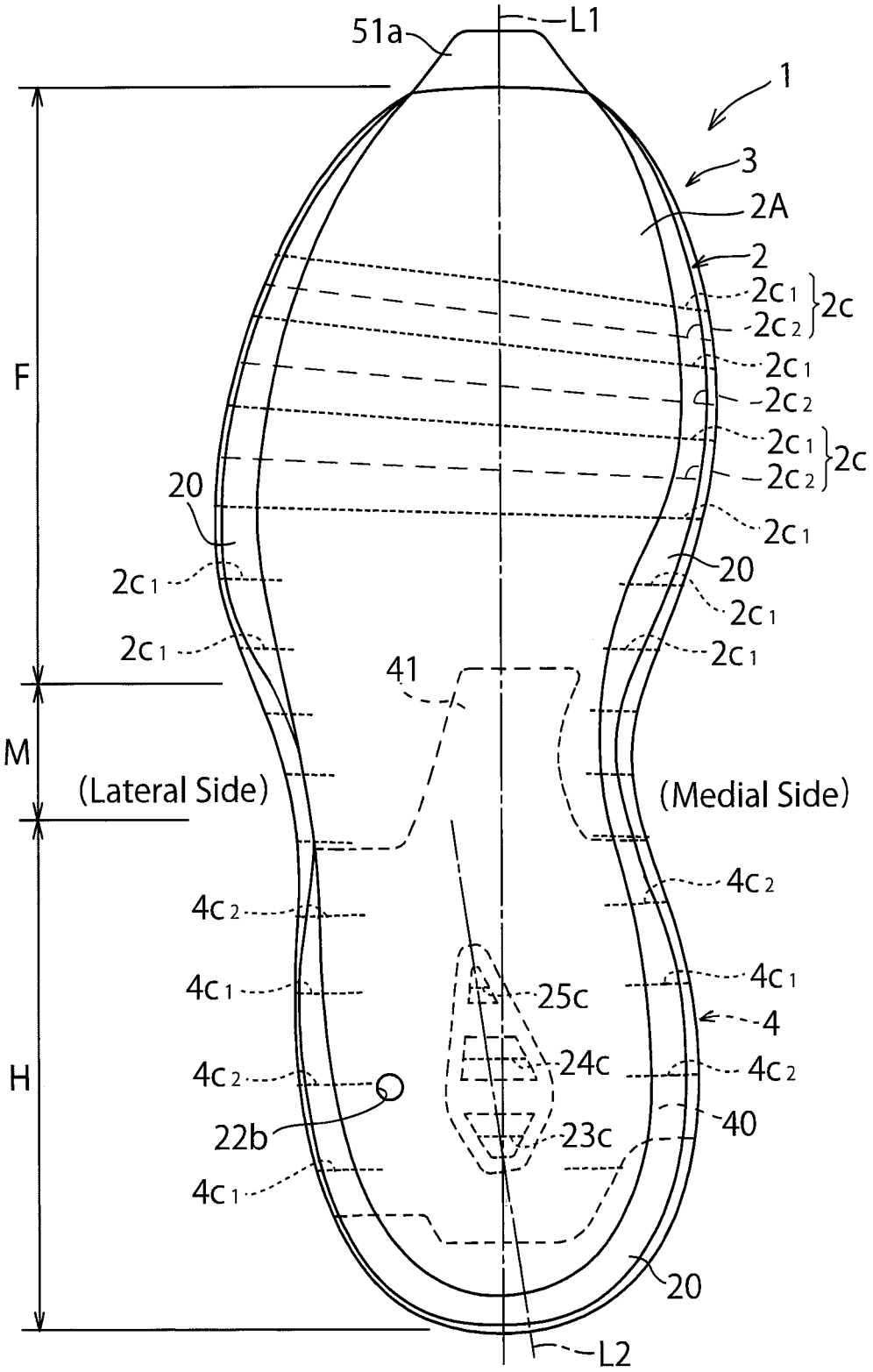
FIG. 1 is a top plan schematic view of a midsole structure for a shoe according to an embodiment of the present invention.

The present invention will now be described in detail with reference to embodiments thereof as illustrated in the accompanying drawings. Referring to the drawings, FIGS. 1 to 17 show a midsole structure for a shoe according to an embodiment of the present invention. Here, a running shoe is taken for an example as a shoe. In the following explanation, "upward (upper side/upper)" and "downward (lower side/lower)" designate an upward direction and a downward direction, or vertical direction, of the shoe, respectively, "forward (front side/front)" and "rearward (rear side/rear)" designate a forward direction and a rearward direction, or longitudinal direction, of the shoe, respectively, and "a width or lateral direction" designates a crosswise direction of the shoe. For example, in the case of FIG. 1, "upward" and "downward" designate "out of the page" and "into the page" of FIG. 1 respectively, "forward" and "rearward" designate "upward" and "downward" in FIG. 1 respectively, and "a width direction" designates "left to right direction" in FIG. 1. Also, in FIG. 1, reference characters H, M and F designate a heel region, a midfoot region and a forefoot region of the midsole structure, respectively, which are adapted to correspond to a heel portion, a midfoot portion and a forefoot portion of a foot of a shoe wearer, respectively. Furthermore, in the drawings, a reference character L1 designates a longitudinal centerline of the midsole structure, and a reference character L2 designates a longitudinal centerline of the heel region, i.e. heel centerline, of the midsole structure.

Figure 11:
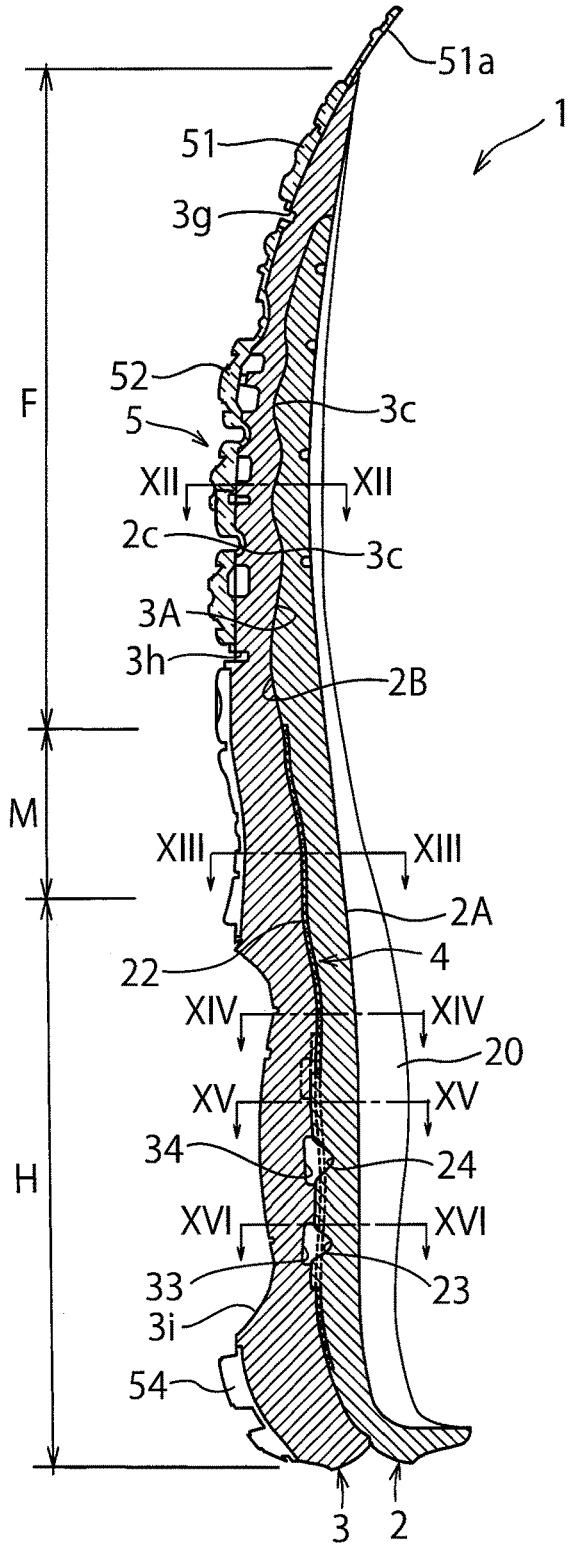
FIG. 11 is a schematic longitudinal sectional view of FIG. 2 taken along line XI-XI.
Figure 12:
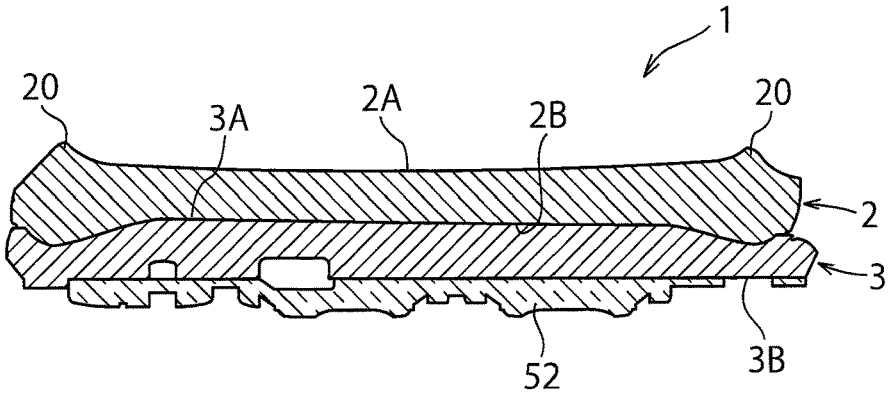
FIG. 12 is a schematic cross sectional view of FIGS. 2 to 4 and 11 taken along line XII-XII.
Figure 13:
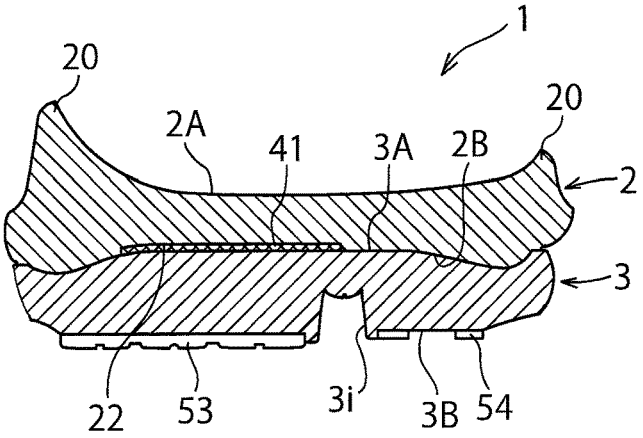
FIG. 13 is a schematic cross sectional view of FIGS. 2 to 4 and 11 taken along line XIII-XIII.
Figure 14:
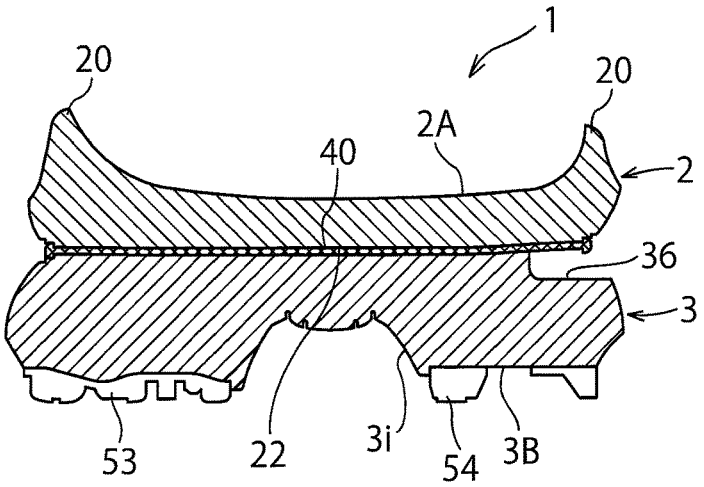
FIG. 14 is a schematic cross sectional view of FIGS. 2 to 4 and 11 taken along line XIV-XIV.

As shown in FIGS. 1 to 4, a midsole structure 1 includes an upper midsole 2 disposed on an upper side of the midsole structure 1 and extending from the heel region H through the midfoot region M to the forefoot region F, a lower midsole 3 disposed on a lower side of the midsole structure 1 and similarly extending from the heel region H through the midfoot region M to the forefoot region F, and a wavy sheet 4 interposed between the upper midsole 2 and the lower midsole 3 in a region extending primarily from the heel region H to the midfoot region M. The upper and lower midsoles 2, 3 and the wavy sheet 4 are fixedly attached and integrated to each other by bonding and the like (see FIG. 11 showing a longitudinal sectional view of FIG. 2, and FIGS. 12 to 16 showing cross sectional views of FIG. 2).

The upper midsole 2 has an upper surface 2A disposed on a foot sole side of a shoe wearer (i.e. on an upper side of the midsole structure 1), a pair of upraised portions 20 disposed along medial and lateral side edges and a heel rear end edge of the upper surface 2A and extending upwardly from the upper surface 2A, and a lower surface 2B disposed on a ground contact side (i.e. on a lower side of the midsole structure 1). The upper surface 2A extends gently curvedly in a longitudinal and lateral direction so as to conform to a foot sole shape. The lower surface 2B has a wavy shape that progresses in the longitudinal direction. In this exemplification, as a wavy shape, a sine wave shape is shown (see FIGS. 3 and 4).

Figure 5:
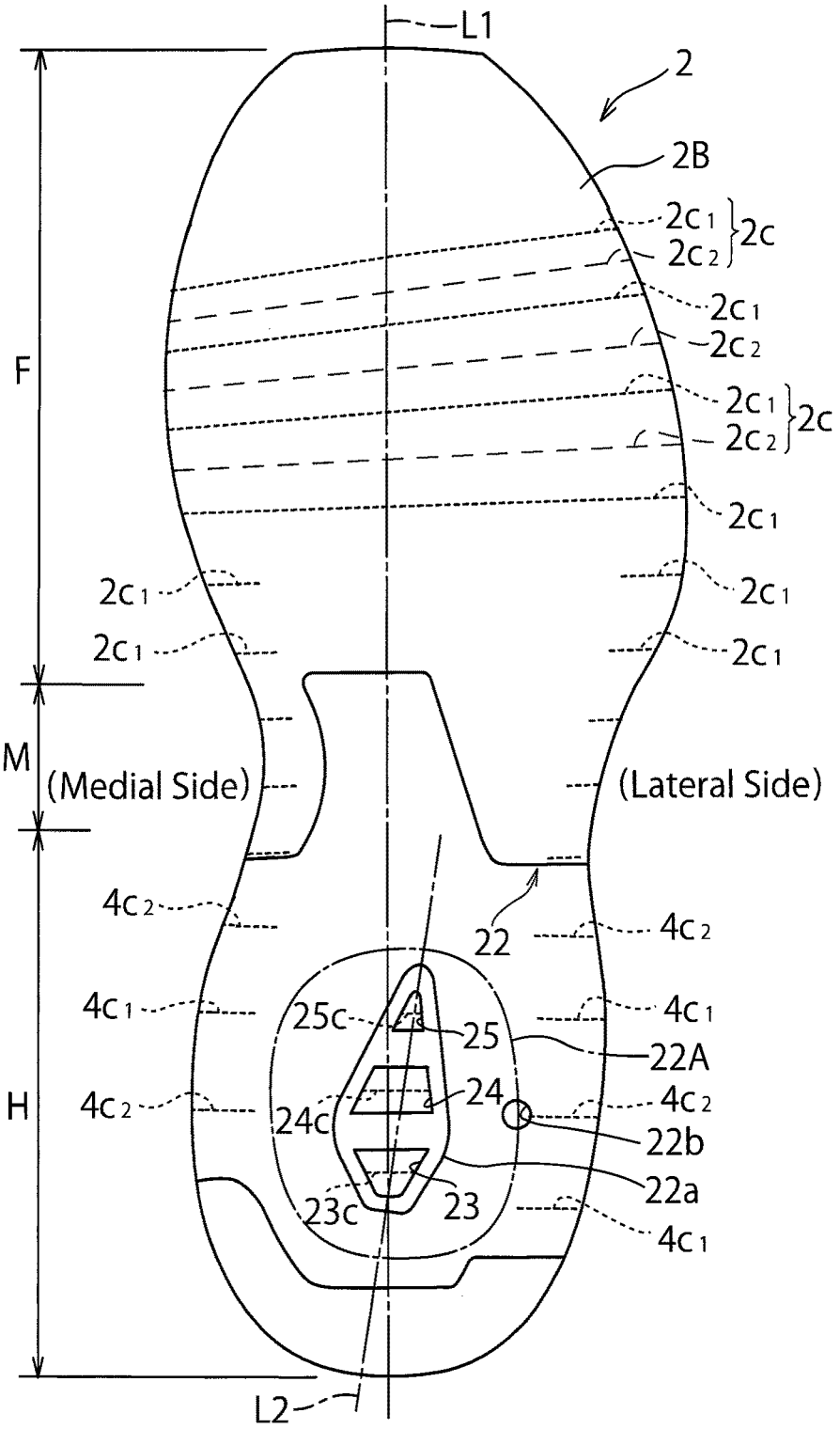
FIG. 5 is a bottom schematic view of the upper midsole that constitutes the midsole structure of FIG. 1.

FIG. 5 shows a bottom of the upper midsole 2. In the drawing, ridge lines $\mathbf{2}c_2$ (i.e. crest lines) and trough lines $\mathbf{2}c_1$ (i.e. ravine lines) of the wavy shape formed on the lower surface 2B of the upper midsole 2 are shown by respective distinct dotted lines 2*c*. Here, the ridge lines $\mathbf{2}c_2$ of the wavy shape of the upper midsole 2 are lines formed by connecting apexes of convexes of the wavy shape, and the trough lines $\mathbf{2}c_1$ of the wavy shape are lines formed by connecting deepest points of concaves of the wavy shape. As shown in FIG. 5, in a longitudinal central area of the forefoot region F, the wavy shape of the lower surface 2B extends along an entire width of the upper midsole 2 from the medial side to the lateral side. Also, in a region extending from a longitudinally rear side of the forefoot region F through the midfoot region M to the heel region H, the wavy shape of the lower surface 2B is not formed at a laterally central area but formed only at the medial and lateral side edges (see FIG. 11). In addition, the ridge lines 2*c*2 and the trough lines $\mathbf{2}c_1$ are disposed in the generally lateral or width direction in the heel region H and the midfoot region M, but are gradually increasingly inclined toward a toe in the forefoot region F, with each incline respectively sloping closer toward the toe while progressing from the medial side to the lateral side in a fan shape or radially. That is based on the direction of a load transfer at the time of running.

The lower midsole 3 has an upper surface 3A disposed on the foot sole side of the shoe wearer (i.e. on the upper side of the midsole structure 1) and a lower surface 3B disposed on the ground contact side (i.e. on the lower side of the midsole structure 1). The upper surface 3A has a wavy shape that progresses in the longitudinal direction. In this exemplification, as a wavy shape, a sine wave shape is shown (see FIGS. 3 and 4).

Figure 6:
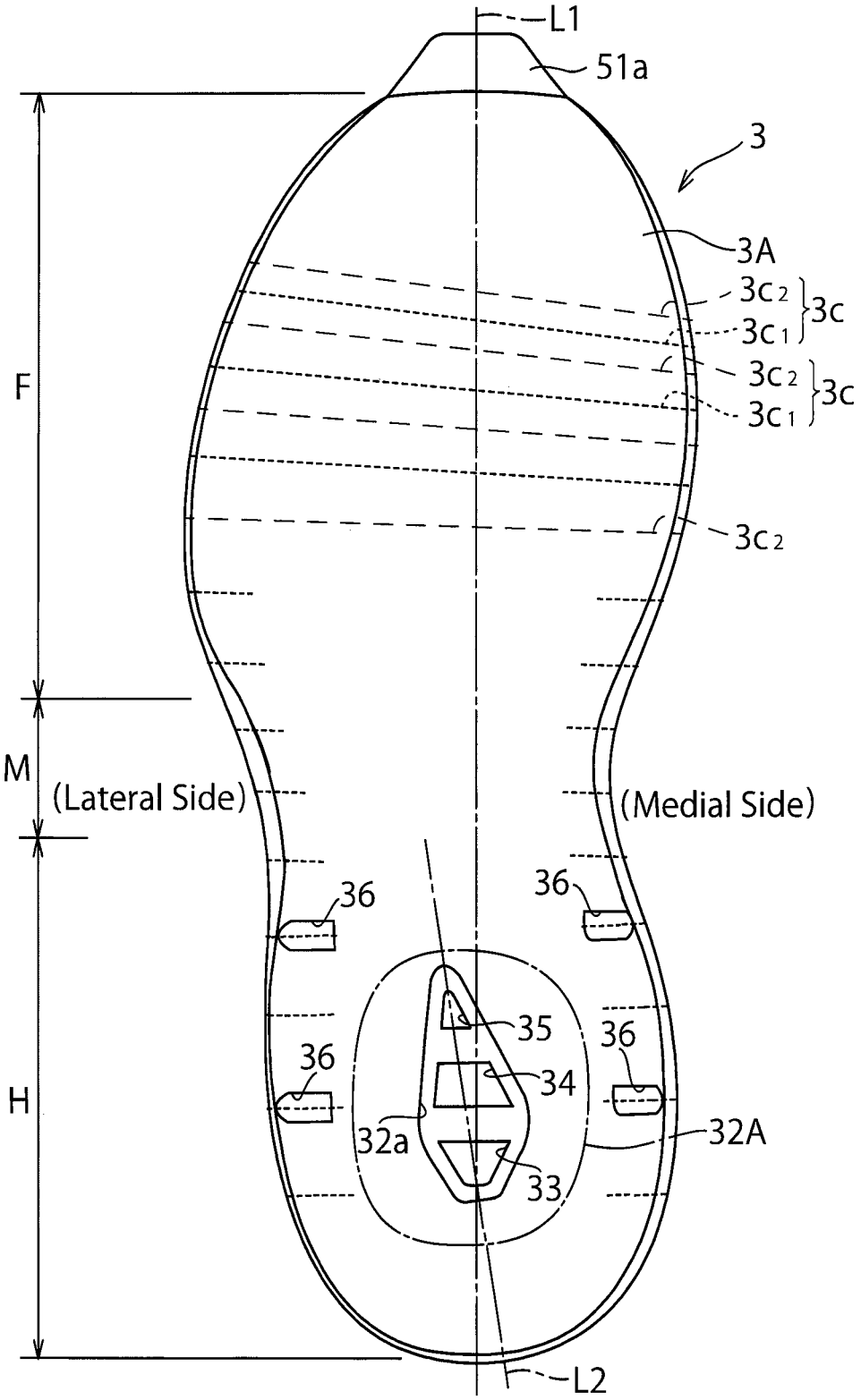
FIG. 6 is a top plan schematic view of the lower midsole that constitutes the midsole structure of FIG. 1.

FIG. 6 is a top plan view of the lower midsole 3. In the drawing, ridge lines 3*c*2 (i.e. crest lines) and trough lines 3*c*1 (i.e. ravine lines) of the wavy shape formed on the upper surface 3A of the lower midsole 3 are shown by respective distinct dotted lines 3*c*. As with the wavy shape of the upper midsole 2, the ridge lines $\mathbf{3}c_2$ of the wavy shape of the lower midsole 3 are lines formed by connecting apexes of convexes of the wavy shape, and the trough lines $\mathbf{3}c_1$ of the wavy shape of the lower midsole 3 are lines formed by connecting deepest points of concaves of the wavy shape. As shown in FIG. 6, similar to the wavy shape of the upper midsole 2, in the longitudinally central area of the forefoot region F, the wavy shape of the upper surface 3A extends along an entire width of the lower midsole 3 from the medial side to the lateral side. Also, in a region extending from the longitudinally rear side of the forefoot region F through the midfoot region M to the heel region H, the wavy shape of the upper surface 3A is not formed at the laterally central area but formed only at the medial and lateral side edges (see FIG. 11). In addition, the ridge lines 3*c*2 and the trough lines $\mathbf{3}c_1$ are disposed in the generally lateral or width direction in the heel region H and the midfoot region M, but are gradually increasingly inclined toward the toe in the forefoot region F, with each incline respectively sloping closer toward the toe while progressing from the medial side to the lateral side in a fan shape or radially. That is also based on the direction of the load transfer at the time of running.

The wavy shape of the upper surface 3A of the lower midsole 3 has a complementary form with (i.e. a corresponding or fitting form to) the form of the wavy shape of the lower surface 2B of the upper midsole 2. A ridge shape of the wavy shape of one of the upper and lower midsoles 2, 3 is engageable with a trough shape of the wavy shape of the other of the upper and lower midsoles 2, 3, and a trough shape of the wavy shape of one of the upper and lower midsoles 2, 3 is engageable with a ridge shape of the wavy shape of the other of the upper and lower midsoles 2, 3 (see FIGS. 12 to 16). FIGS. 1 to 4 show the state in which the ridge lines $\mathbf{2}c_2$ or trough lines $\mathbf{2}c_1$ of the wavy shape of the lower surface 2B of the upper midsole 2 coincide with the trough lines $\mathbf{3}c_1$ or ridge lines $\mathbf{3}c_2$ of the wavy shape of the upper surface 3A of the lower midsole 3 in the vertical direction.

Figure 2:
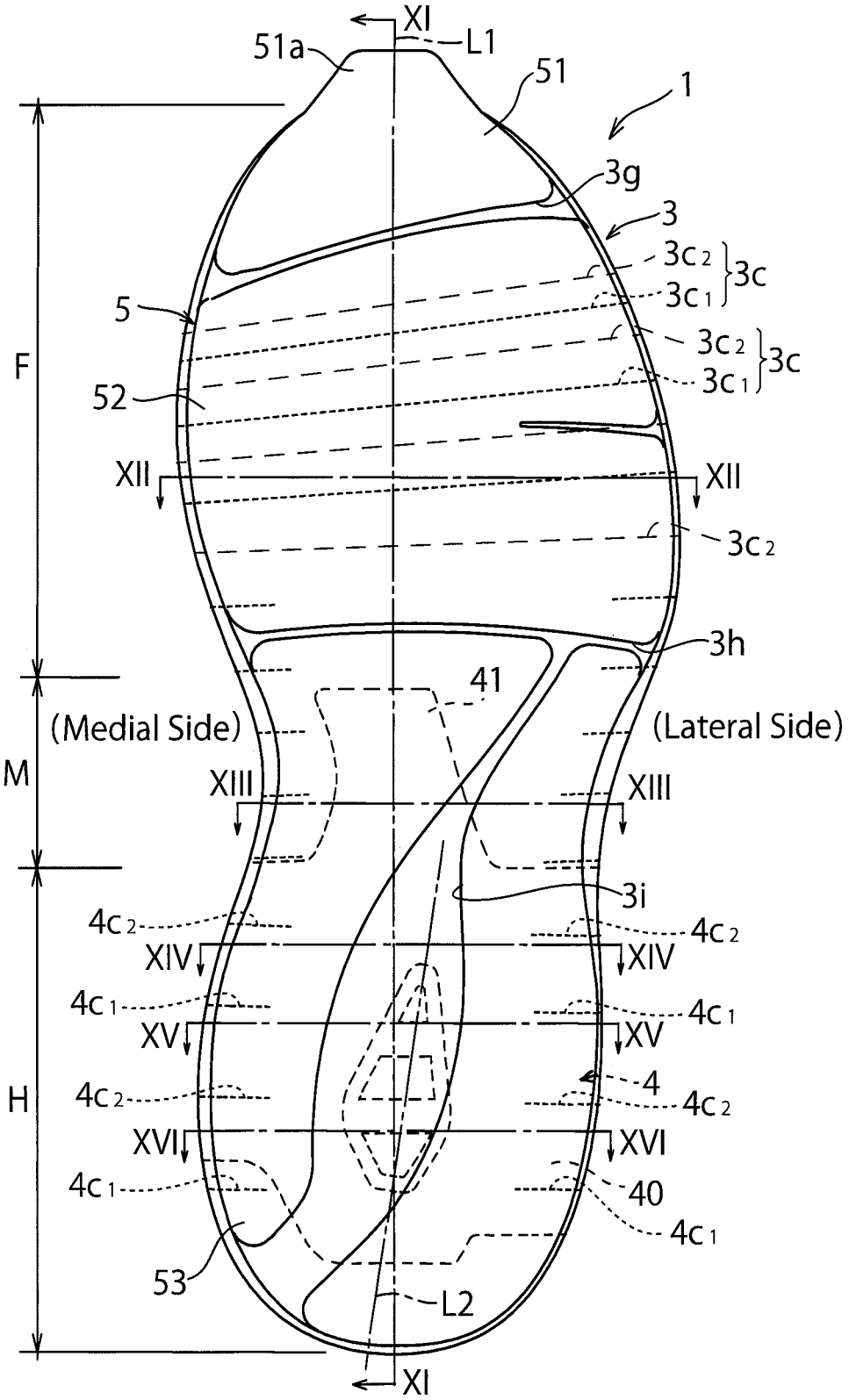
FIG. 2 is a bottom schematic view of the midsole structure of FIG. 1.

An outsole 5 is attached on a lower surface 3B of the lower midsole 3. As shown in FIG. 2, the outsole 5 has an outsole part 51 disposed at a toe portion of the forefoot region F, an outsole part 52 disposed at a tread portion at the rear of the outsole part 51 in the forefoot region F, and outsole parts 53, 54 disposed on the medial and lateral sides respectively in a region extending from the midfoot region M to the heel region H. The outsole parts 51 to 54 are separated from each other in the longitudinal/lateral direction through grooves 3*g*, 3*h*, 3*i* formed on the lower surface 3B of the lower midsole 3. In addition, lower surfaces of the outsole parts 51 to 54 has grooves (not shown) formed thereon for improving a skid-proof capacity/grip performance/durability/design effect, or weight reduction. Also, a tip end of the outsole part 51 has an elongation 51*a* to be fixedly attached to a toe portion of an upper of the shoe.

Figure 7:
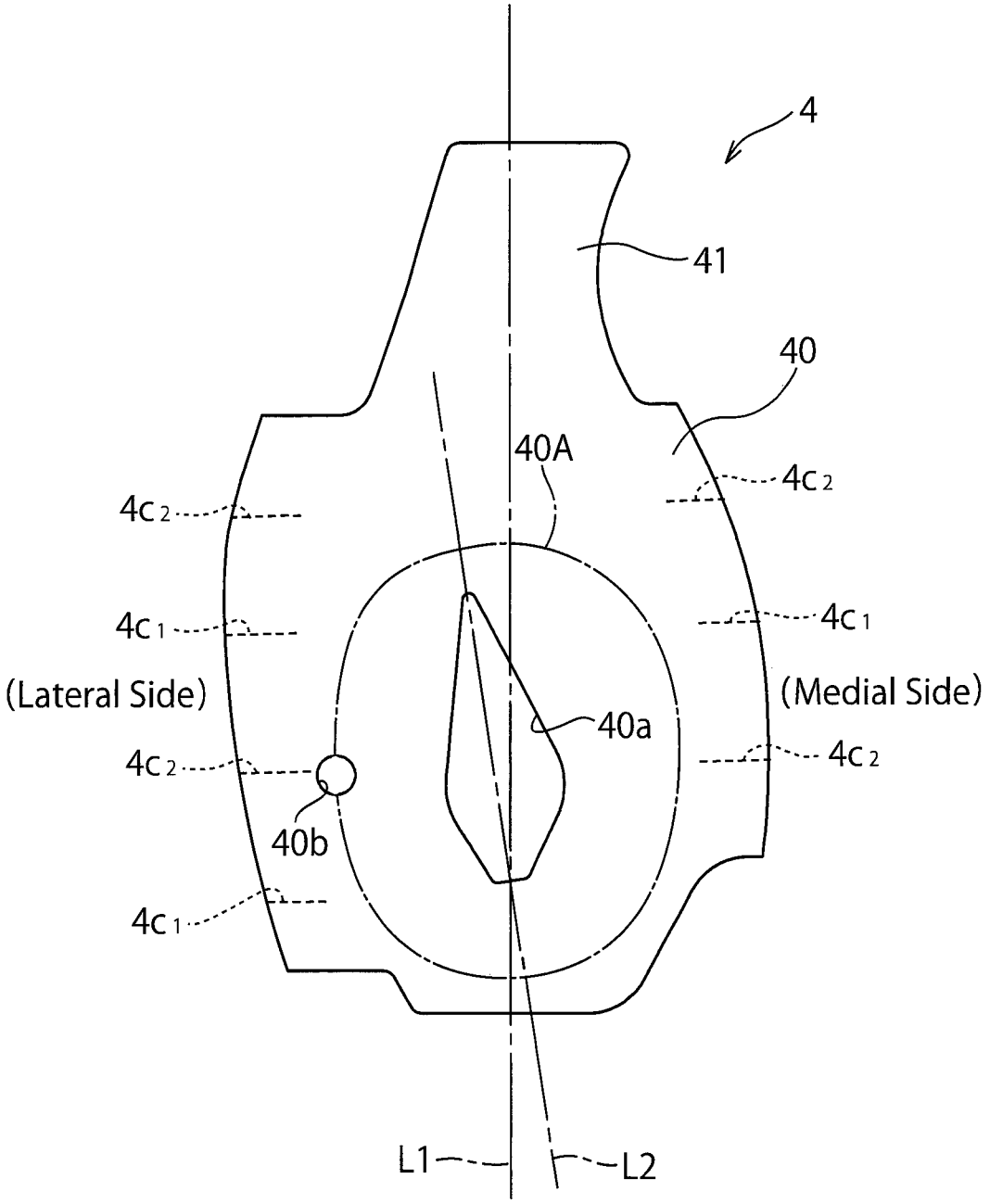
FIG. 7 is a top plan schematic view of the wavy sheet that constitutes the midsole structure of FIG. 1.
Figure 8:
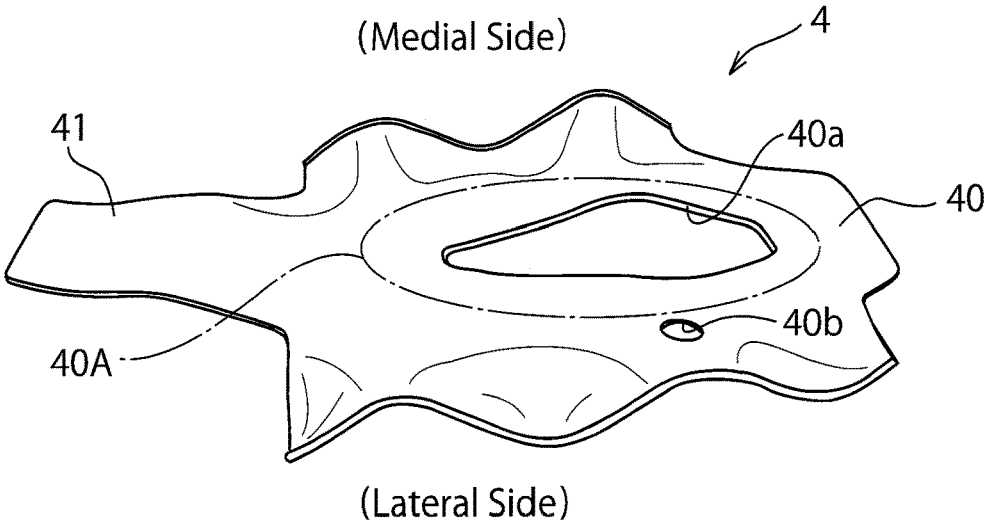
FIG. 8 is a perspective view of the entire wavy sheet of FIG. 7 viewed from above.

The wavy sheet 4 is a thin sheet-like member and as shown in FIGS. 7 and 8, has a base portion 40 extending in the longitudinal and lateral directions and an elongated portion 41 extending forwardly from a front end of the base portion 40.

The base portion 40 of the wavy sheet 4 has a substantially planar area 40A (shown and encircled by a dash-and-dot line) formed in the center thereof, and a pair of wavy shapes formed on medial and lateral side edges of the base portion 40. Here, the phrase, "substantially planar" is used to include not only a perfect flat state but also a slightly curved state along the longitudinal and/or lateral directions. In the center of the planar area 40A of the base portion 40, there is formed an aperture 40*a* that penetrates the planar area 40A in the vertical direction. The aperture 40*a* has an elongated shape extending along the heel center line L2. In this exemplification, the aperture 40*a* has a generally rhombus shape but may adopt an optional suitable shape. Also, at a position near the lateral side of the base portion 40, a small hole 40*b* is formed extending in the vertical direction.

Figure 9:
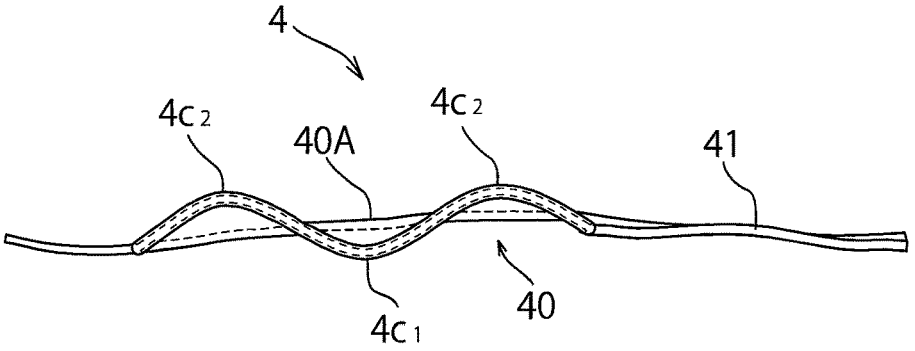
FIG. 9 is a medial side view of the wavy sheet of FIG. 7.
Figure 10:
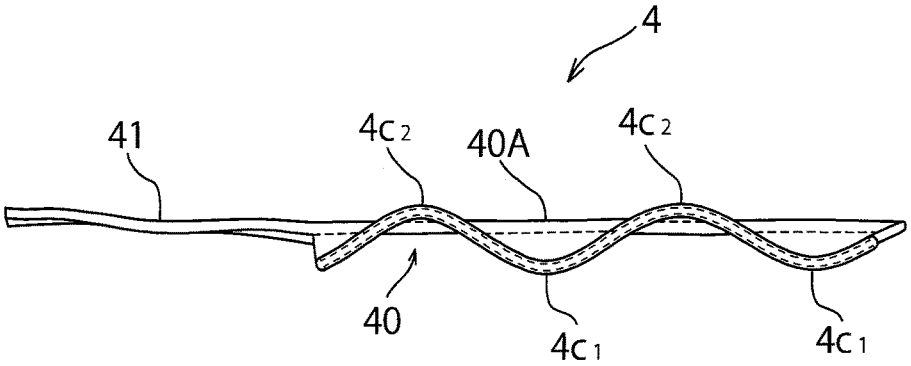
FIG. 10 is a lateral side view of the wavy sheet of FIG. 7.

The wavy shape on the medial side of the base portion 40 is formed of two ridge shapes spaced longitudinally from each other and one trough shape located between the two ridge shapes, as shown in FIG. 9. The wavy shape on the lateral side of the base portion 40 is formed of two ridge shapes and two trough shapes that are interleaved with each other, that is, arranged alternately, as shown in FIG. 10. In FIG. 7, the ridge lines $4c_2$ and trough lines $4c_1$ of each of the wavy shapes are designated by dotted lines FIGS. 1 to 4 show the state in which the ridge lines $4c_2$ of the wavy shape of the wavy sheet 4 coincide with the trough lines $2c_1$ and the ridge lines 3*c*2, and the trough lines $4c_1$ of the wavy shape of the wavy sheet 4 coincide with the ridge lines $2c_2$ and the trough lines $3c_1$, of the wavy shape of the upper and lower midsoles 2, 3 in the vertical direction. That is, each of the wavy shapes of the upper and lower midsoles 2, 3 corresponds respectively to the wavy shape of the wavy sheet 4.

As shown in FIG. 5, on the lower surface 2B of the upper midsole 2, there is formed a depression or concavity, i.e. a recess 22 that follows the contour of the wavy sheet at an area extending from the heel region H to the midfoot region M. The recess 22 is adapted to accommodate the wavy sheet 4. In the center of the recess 22, a planar area 22A (encircled by a dash-and-dot line) is formed that has a planar surface which corresponds to the central planar area 40A of the wavy sheet 4. In the center of the planar area 22A, there is formed a bulging part 22*a* that bulges downwardly from the planar area 22A. The bulging part 22*a* is sized and shaped to correspond to the central aperture 40*a* of the wavy sheet 4 and adapted to be fit into the aperture 40*a* of the wavy sheet 4.

The bulging part 22*a* has recesses 23, 24, 25 formed thereon. The recesses 23, 24, 25 are spaced apart from each other in the substantially longitudinal direction. Here, phrase, "substantially longitudinal direction" means to include not only the direction perfectly along the longitudinal centerline L1 of the midsole structure 1 or the heel centerline L2 but also the direction that intersects the centerlines L1/L2 diagonally. That is, such a phrase indicates every longitudinal direction except the direction that coincides with the width or lateral direction of the midsole structure 1 and the phrase excludes only the state in which the recesses 23, 24, 25 are aligned with the width direction. In this exemplification, the recess 23 is disposed along the longitudinal centerline L1, the recess 25 is disposed generally along the heel centerline L2, and the recess 24 is disposed along a longitudinal centerline (not shown) that is located between the longitudinal centerline L1 and the heel center line L2.

Figure 17:
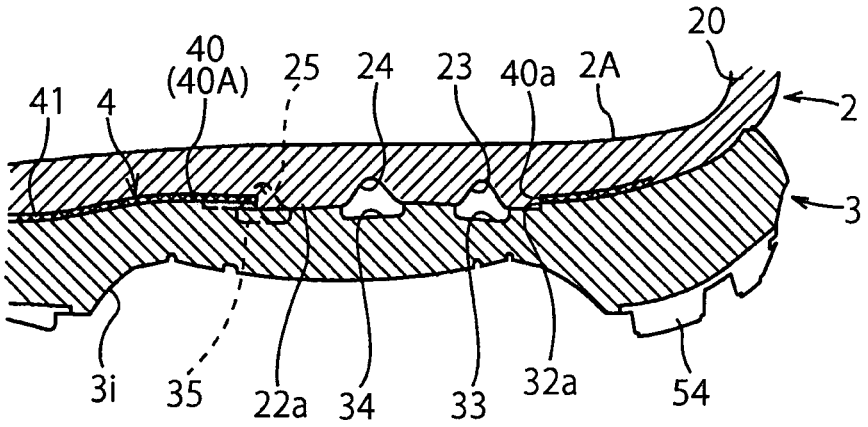
FIG. 17 is an enlarged view of the heel region of FIG. 11.

As shown in FIG. 17, an enlarged view of the heel region H in FIG. 11, each of the recesses 23, 24, 25 is formed in a roundly triangular shape or a sine wave shape (i.e. a sinusoid shape). In FIG. 5, there are shown trough lines 23*c*, 24*c*, 25*c* that are formed by connecting the deepest portions of the recesses 23, 24, 25. In this exemplification, each of the trough lines 23*c*, 24*c*, 25*c* extends in the substantially width direction. Here, phrase, "substantially width direction" are used to include not only a direction that is perpendicular to the longitudinal centerline L1 of the midsole structure 1 but also a direction that intersects the longitudinal centerline L1 diagonally. Also, at a position near the lateral side of the planar area 22A, a small through hole 22*b* is formed thereinto in the vertical direction. The hole 22*b* is aligned with the hole 40*b* in the base part 40 of the wavy sheet 4 in the vertical direction. These through holes 22*b*, 40*b* act as a vent hole of the midsole structure 1.

Figure 15:
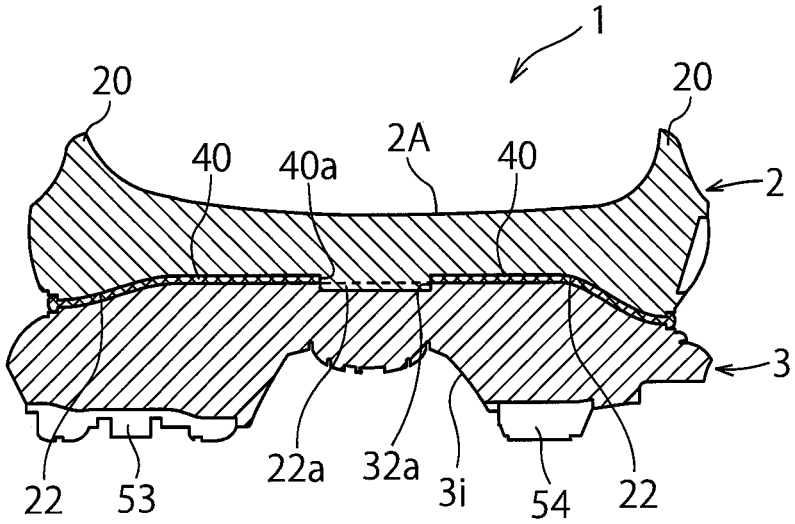
FIG. 15 is a schematic cross sectional view of FIGS. 2 to 4 and 11 taken along line XV-XV.
Figure 16:
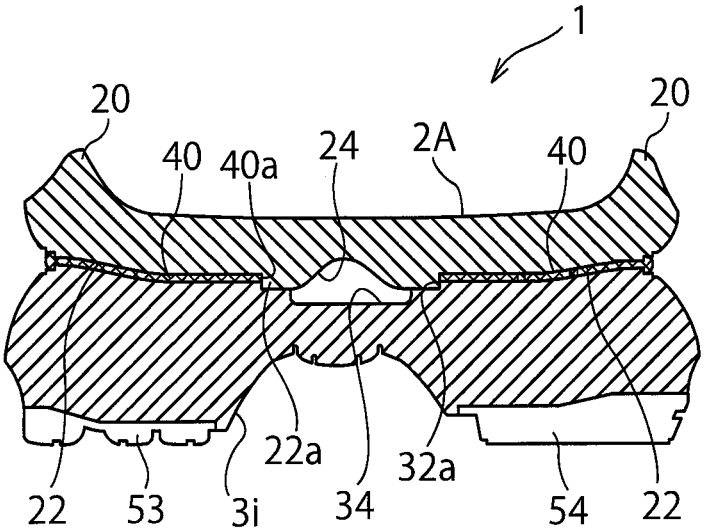
FIG. 16 is a schematic cross sectional view of FIGS. 2 to 4 and 11 taken along line XVI-XVI.

As shown in FIG. 6, in the central area of the heel region H on the upper surface 3A of the lower midsole 3, there is formed a planar area 32A (encircled by a dash-and-dot line) that has a planar surface corresponding to the central planar area 40A of the wavy sheet 4. In the center of the planar area 32A, a stepped portion 32*a* is formed that falls downward from the planar area 32A. The stepped portion 32*a* is sized and shaped to correspond to the bulging portion 22*a* of the lower surface 2B of the upper midsole 2 and to allow the bulging portion 22*a* to fit thereinto (FIGS. 15 to 17).

The stepped portion 32*a* has recesses 33, 34, 35 formed thereon. The recesses 33, 34, 35 are spaced apart from each other in the substantially longitudinal direction. Here, phrase, "substantially longitudinal direction" means to include not only the direction along the perfect longitudinal centerline L1 of the midsole structure 1 or the perfect heel centerline L2 but also the direction that intersects the centerlines L1/L2 diagonally. That is, such a phrase indicates every longitudinal direction except the direction that coincides with the width or lateral direction of the midsole structure 1 and the phrase excludes only the state in which the recesses 33, 34, 35 are aligned with the width direction. In this exemplification, the recess 33 is disposed along the longitudinal centerline L1, the recess 35 is disposed generally along the heel centerline L2, and the recess 34 is disposed along a longitudinal centerline (not shown) that is located between the longitudinal centerline L1 and the heel center line L2.

Figure 3:
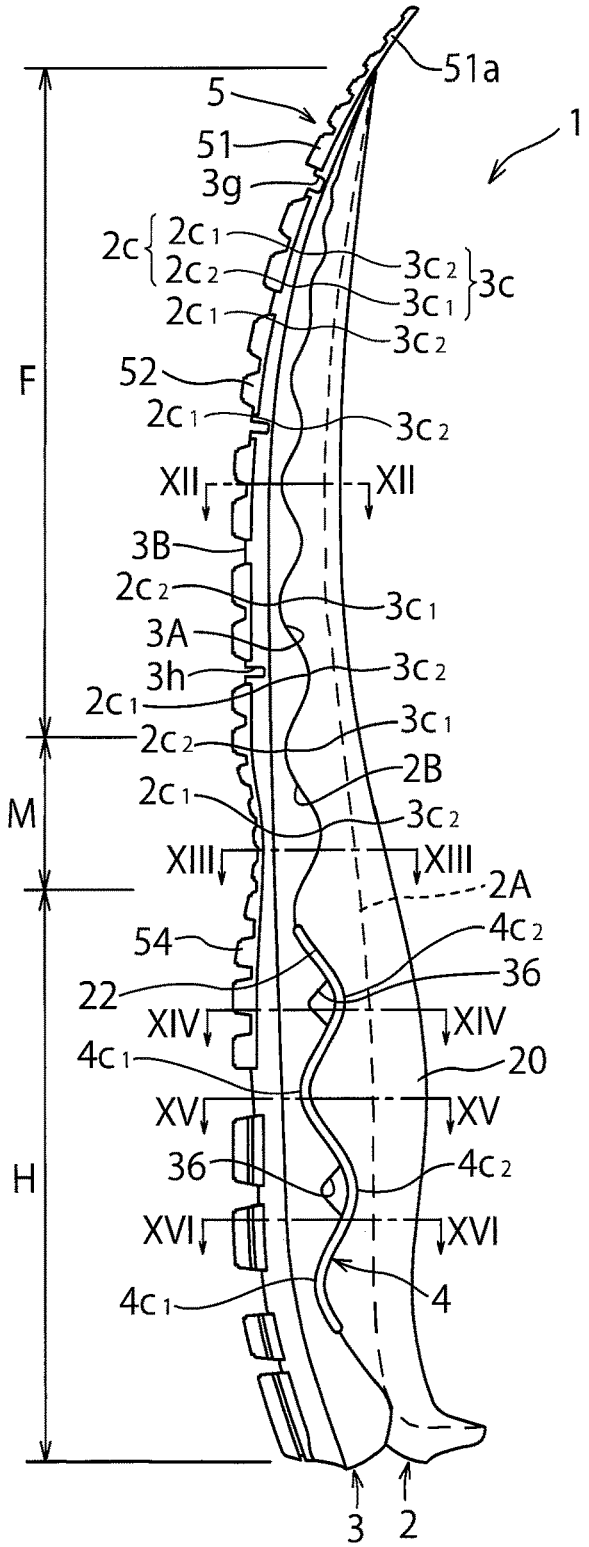
FIG. 3 is a lateral side view of the midsole structure of FIG. 1.
Figure 4:
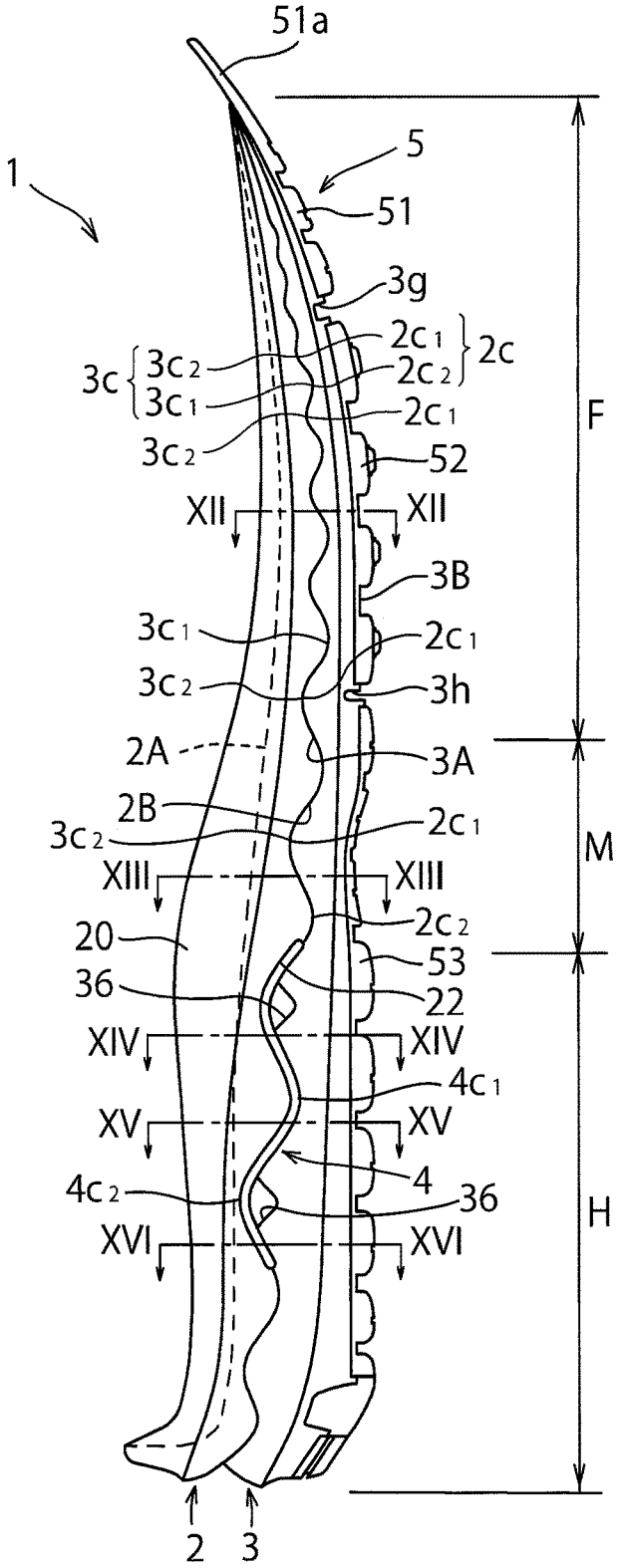
FIG. 4 is a medial side view of the midsole structure of FIG. 1.

As shown in FIG. 17, an enlarged view of the heel region H in FIG. 11, each of the recesses 33, 34, 35 is formed in a roundly square or rectangular shape and a bottom surface thereof is planar in shape. In this exemplification, the recesses 33, 34, 35 of the upper surface 3A of the lower midsole 3 respectively correspond to the recesses 23, 24, 25 of the lower surface 2B of the upper midsole 2. The respectively corresponding recesses are aligned with each other in the vertical direction. In FIG. 17, undulations i.e. ups and downs including any of the recesses are repeated in the longitudinal direction on the lower surface 2B of the upper midsole 2. Similarly, undulations i.e. ups and downs including any of the recesses are repeated in the longitudinal direction on the upper surface 3A of the lower midsole 3. Therefore, repetition of the undulations of the recesses can be regarded as a wave shape. Also, on the medial and lateral side edges of the upper surface 3A of the lower midsole 3, at the positions of the ridge lines $3c_2$ of the wavy shape, concave portions 36 are formed that extend along the ridge lines $3c_2$ inwardly in the lateral direction. The concave portions 36 function as cushion holes when the upper midsole 2 and the wavy sheet 4 are incorporated into the lower midsole 3 (FIGS. 3 and 4).

The upper and lower midsoles 2, 3 are formed of soft elastic materials, more specifically, thermoplastic resin such as ethylene-vinyl acetate copolymer (EVA) and the like, foamed thermoplastic resin, thermosetting resin such as polyurethane (PU) and the like, foamed thermosetting resin, elastomers of these resin, rubber materials such as butadiene rubber, chloroprene rubber and the like, or foamed rubber materials.

The wavy sheet 4 is formed of thermoplastic resin comparatively rich inelasticity such as thermoplastic polyurethane (TPU), polyamide elastomer (PAE), acrylonitrile butadiene styrene resin (ABS) and the like, alternatively, thermosetting resin such as epoxy resin, unsaturated polyester resin and the like. Also, fiber reinforced plastics (FRP) may be adopted in which carbon fibers, aramid fibers, glass fibers or the like are incorporated as reinforced fiber, and thermosetting resin or thermoplastic resin are incorporated as matrix resin.

The outsole 5 is formed of hard elastic materials, more specifically, thermoplastic resin such as thermo plastic polyurethane (TPU), polyamideelastomer (PAE) and the like, thermosetting resin such as epoxy resin and the like, or solid rubber.

As for the shoe incorporating the above-mentioned midsole structure 1, when a shoe wearer impacts the ground on the heel, the wavy shapes disposed on the sheet medial and lateral sides of the wavy sheet 4 restricts a sinking movement of the sole medial and lateral sides of the upper and lower midsoles 2, 3 and thus prevents the heel region H of the upper and lower midsoles 2, 3 from deforming sideways. Thereby, the heel portion of a foot of the wearer can be restricted from leaning to the medial and lateral sides to secure landing stability of the heel portion. Also, the central portion of the wavy sheet 4 has a planar area 40A without a wavy shape, the aperture 40*a* is formed in the central portion of the planar area 40A of the wavy sheet 4, and the wavy sheet 4 is not provided in the heel central portion, thus further securing cushioning properties of the heel central portion.

Moreover, in the central portion of the heel region H, since the lower surface 2B of the upper midsole 2 has a plurality of recesses 23, 24, 25 and the upper surface 3A of the lower midsole 3 has a plurality of recesses 33, 34, 35, those recesses function as cushioning holes at the time of a heel impact, thus further improving cushioning properties of the heel central portion.

Furthermore, when a load travels at the time of impacting the ground, the plurality of recesses 23, 24, 25; 33, 34, 35 disposed on the lower surface 2B of the upper midsole 2 and the upper surface 3A of the lower midsole 3 respectively in the substantially longitudinal direction can exhibit a load guiding function at the heel central portion, such that thereby controlling a bending direction at the heel central portion.

The above-mentioned embodiment is suitable for the present invention, but application of the present invention is not limited to such an embodiment. The present invention also involves various embodiments and some of them will be shown hereinafter.

First Alternative Embodiment

In the above-mentioned embodiment, an example was shown in which both the medial side edge and the lateral side edge of the wavy sheet 4 have wavy shapes (FIGS. 3, 4, 8-10), but the present invention is not limited to such an example. The present invention also has application to an example in which either the medial side edge or the lateral side edge of the wavy sheet 4 has a wavy shape.

Second Alternative Embodiment

In the above-mentioned embodiment, an example was shown in which both the respective medial side edges and the lateral side edges of the lower surface 2B of the upper midsole 2 and upper surface 3A of the lower midsole 3 have wavy shapes (FIGS. 3, 4), but the present invention is not limited to such an example. The present invention also has application to an example in which either the respective medial side edges or the lateral side edges of the lower surface 2B of the upper midsole 2 and upper surface 3A of the lower midsole 3 have wavy shapes.

Third Alternative Embodiment

In the above-mentioned embodiment, an example was shown in which the shape of each of the recesses 33, 34, 35 formed on the upper surface 3A of the lower midsole 3 differs from the shape of each of the recesses 23, 24, 25 formed on the lower surface 2B of the upper midsole 2 (FIGS. 11, 16, 17), but the present invention is not limited to such an example. The present invention also has application to an example in which the shapes of the recesses 33, 34, 35 are the same as the shapes of the recesses 23, 24, 25.

Figure 18:
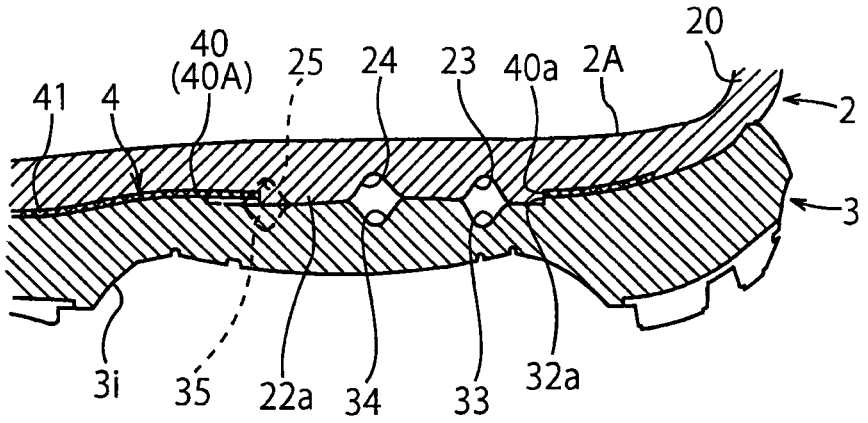
FIG. 18 illustrates a third variant of the present invention, which corresponds to FIG. 17.

FIG. 18 illustrates a third alternative embodiment of the present invention. In the drawing, the same reference numbers as those in FIG. 17 of the above-mentioned embodiment indicate identical or functionally similar elements. As shown in FIG. 18, each of the recesses 33, 34, 35 formed on the upper surface 3A of the lower midsole 3 has a rounded triangular shape or sine wave shape, which is the same as or similar to the shape of each of the recesses 23, 24, 25 formed on the lower surface 2B of the upper midsole 2. In this case as well, each of the recesses 33, 34, 35 of the lower midsole 3 is aligned with each of the recesses 23, 24, 25 of the upper midsole 2 in the vertical direction. That is, each of the trough lines of the recesses 33, 34, 35 of the lower midsole 3 is vertically aligned with each of the trough lines of the recesses 23, 24, 25 of the upper midsole 2.

In addition, the shapes of the recesses 33, 34, 35 on the upper surface 3A of the lower midsole 3 and the shapes of the corresponding recesses 23, 24, 25 on the lower surface 2B of the upper midsole 2 may be contrary to those in the above-mentioned embodiment. That is, each of the shapes of the recesses 33, 34, 35 may be a rounded triangular shape and each of the shapes of the recesses 23, 24, 25 may be a rounded rectangular shape. Also, the shape of each of the recesses is not limited to that of the above-mentioned embodiment and various optional forms can be adopted.

Fourth Alternative Embodiment

In the above-mentioned embodiment, an example was shown in which the recesses 23, 24, 25 are formed on the lower surface 2B of the upper midsole 2 and the recesses 33, 34, 35 are formed on the upper surface 3A of the lower midsole 3 (FIGS. 11, 16, 17), but the present invention is not limited to such an example and it also has application to an example in which only either one of the lower surface 2B of the upper midsole 2 and the upper surface 3A of the lower midsole 3 has a recess formed thereon.

Figure 19:
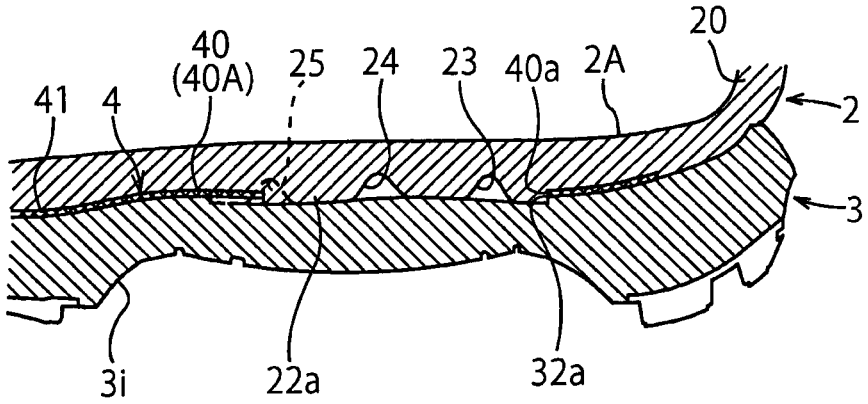
FIG. 19 illustrates a fourth variant of the present invention, which corresponds to FIG. 17.
Figure 20:
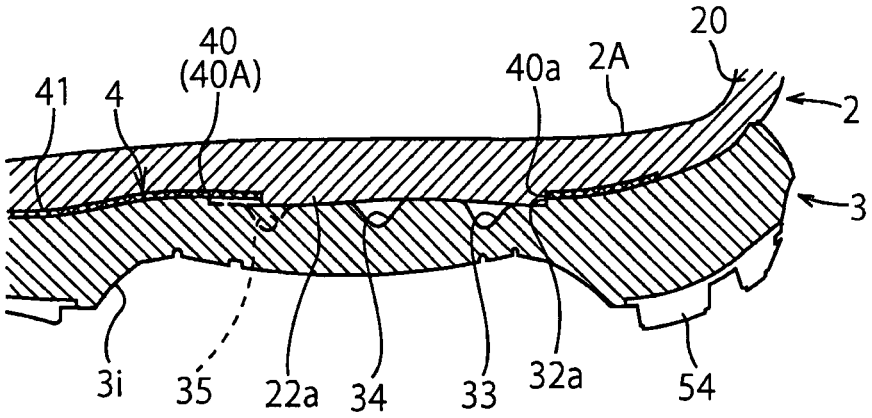
FIG. 20 illustrates a fourth variant of the present invention, which corresponds to FIG. 17.

FIGS. 19 and 20 illustrate a fourth alternative embodiment of the present invention. In these drawings, the same reference numbers as those in FIG. 17 of the above-mentioned embodiment indicate identical or functionally similar elements. In the example shown in FIG. 19, the recesses 23, 24, 25 are formed on the lower surface 2B of the upper midsole 2, but the upper surface 3A of the lower midsole 3 has no recesses formed thereon. In the example shown in FIG. 20, contrary to the example of FIG. 19, the recesses 33, 34, 35 are formed on the upper surface 3A of the lower midsole 3, but the lower surface 2B of the upper midsole 2 has no recesses formed thereon.

Fifth Alternative Embodiment

In the above-mentioned embodiment, an example was shown in which the center of the planar area 40A of the wavy sheet 4 has a vertically extending aperture 40*a* formed thereinto (FIGS. 7, 8, 15-17), but the present invention is not limited to such an example and it also has application to an example in which wavy sheet 4 has no aperture 40 formed thereinto.

Figure 21:
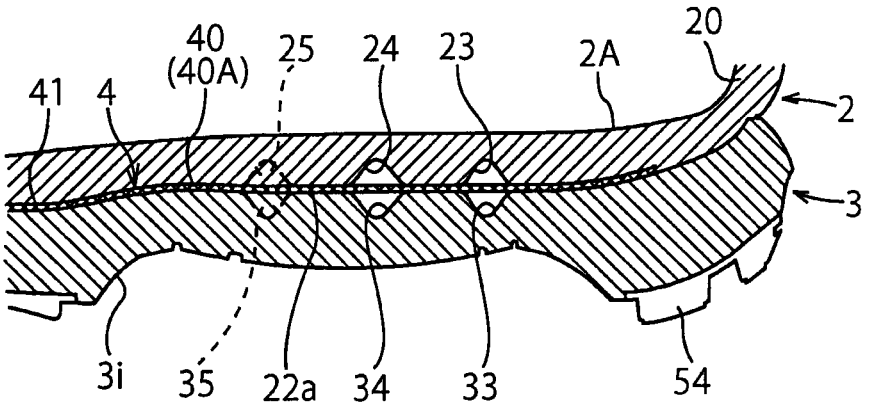
FIG. 21 illustrates a fifth variant of the present invention, which corresponds to FIG. 17.
Figure 22:
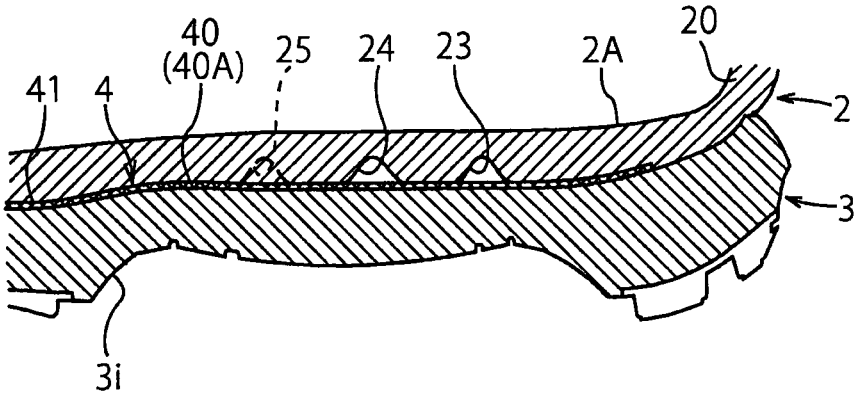
FIG. 22 illustrates a fifth variant of the present invention, which corresponds to FIG. 17.
Figure 23:
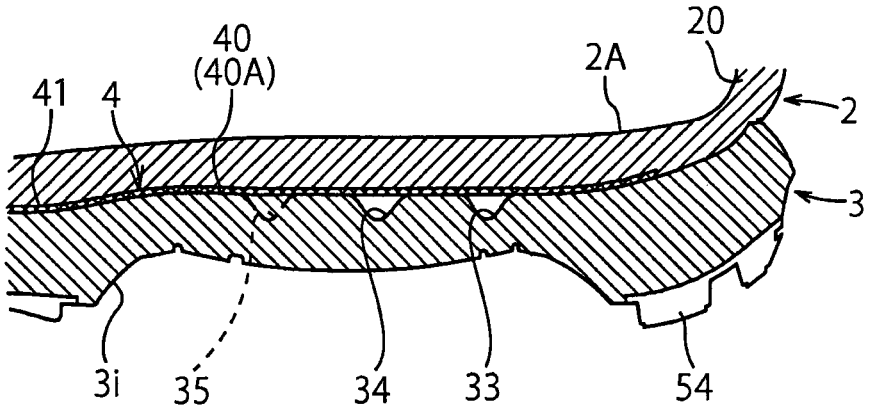
FIG. 23 illustrates a fifth variant of the present invention, which corresponds to FIG. 17.

FIGS. 21 to 23 illustrate a fifth alternative embodiment of the present invention. In these drawings, the same reference numbers as those in FIGS. 18 to 20 of the above third and fourth alternative embodiments indicate identical or functionally similar elements.

As shown in FIG. 21, which corresponds to FIG. 18, the recesses 23, 24, 25 are formed on the lower surface 2B of the upper midsole 2 and the recesses 33, 34, 35 are formed on the upper surface 3A of the lower midsole 3. However, in the center of the planar area 40A of the wavy sheet 4, the upper and lower midsoles 2, 3 are not in direct contact with each other but in indirect contact with each other via the planar area 40A of the wavy sheet 4. As shown in FIG. 22, which corresponds to FIG. 19, the recesses 23, 24, 25 are formed on the lower surface 2B of the upper midsole 2. However, in the center of the planar area 40A of the wavy sheet 4, the upper and lower midsoles 2, 3 are not in direct contact with each other but in indirect contact with each other via the planar area 40A of the wavy sheet 4. As shown in FIG. 23, which corresponds to FIG. 20, the recesses 33, 34, 35 are formed on the upper surface 3A of the lower midsole 3. However, in the center of the planar area 40A of the wavy sheet 4, the upper and lower midsoles 2, 3 are not in direct contact with each other but in indirect contact with each other via the planar area 40A of the wavy sheet 4.

According to the fifth alternative embodiment, since the planar area 40A of the wavy sheet 4 is disposed in the heel central portion and the wavy-shape portion of the wavy sheet 4 is not disposed in the heel central portion, cushioning properties of the heel central portion can be improved at the time of a heel impact. Also, in this case as well, during load travel in landing onto the ground, a plurality of recesses 23, 24, 25 on the lower surface 2B of the upper midsole 2 and/or a plurality of recesses 33, 34, 35 on the upper surface 3A of the lower midsole 3, which are respectively disposed along the substantially longitudinal direction, can exhibit a load guiding function in the heel central portion thus controlling the bending direction of the heel central portion.

Sixth Alternative Embodiment

In the above-mentioned embodiment, an example was shown in which the recesses 23, 24, 25 on the lower surface 2B of the upper midsole 2 are vertically aligned with the recesses 33, 34, 35 respectively on the upper surface 3A of the lower midsole 3, but the present invention is not limited to such an example.

Figure 24:
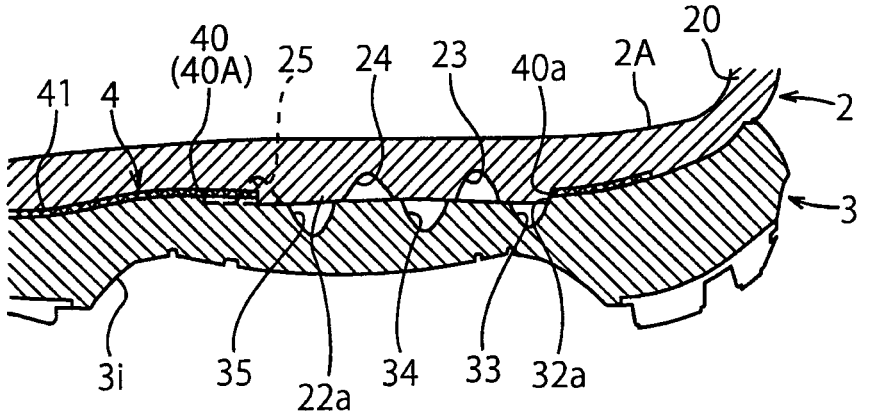
FIG. 24 illustrates a sixth variant of the present invention, which corresponds to FIG. 17.
Figure 25:
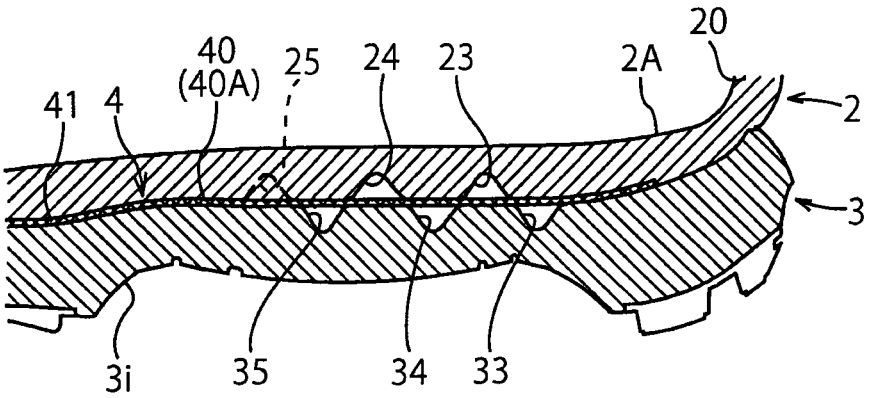
FIG. 25 illustrates a sixth variant of the present invention, which corresponds to FIG. 17.

FIGS. 24 and 25 illustrate a sixth alternative embodiment of the present invention. In these drawings, the same reference numbers as those of the above third and fifth alternative embodiments indicate identical or functionally similar elements. FIG. 24 corresponds to FIG. 18 in the above third alternative embodiment and FIG. 25 corresponds to FIG. 21 in the above fifth alternative embodiment.

In FIG. 24, the recesses 33, 34, 35 on the upper surface 3A of the lower midsole 3 are not vertically aligned with but longitudinally deviated from the recesses 23, 24, 25 on the lower surface 2B of the upper midsole 2. Also, each of the corresponding recesses of the upper and lower midsoles 2, 3 are not vertically overlapped with each other. In this exemplification, the recesses 33, 23, 34, 24, 35, 25 of the upper and lower midsoles 2, 3 form a general sine wave shape that progresses in the longitudinal direction.

Similarly, in FIG. 25, the recesses 33, 34, 35 on the upper surface 3A of the lower midsole 3 are not vertically aligned with but longitudinally deviated from the recesses 23, 24, 25 on the lower surface 2B of the upper midsole 2. Also, each of the corresponding recesses of the upper and lower midsoles 2, 3 are not vertically overlapped with each other. In this exemplification, the recesses 33, 23, 34, 24, 35, 25 of the upper and lower midsoles 2, 3 form a sine wave shape that progresses in the longitudinal direction.

Seventh Alternative Embodiment

In the above-mentioned embodiment, an example was shown in which each of the trough lines 23*c*, 24*c*, 25*c* of the recesses 23, 24, 25 on the lower surface 2B of the upper midsole 2 is disposed along the width direction, but the present invention is not limited to such an example. Any or all of the trough lines 23*c*, 24*c*, 25*c* may be disposed diagonally relative to the width direction.

Figure 26:
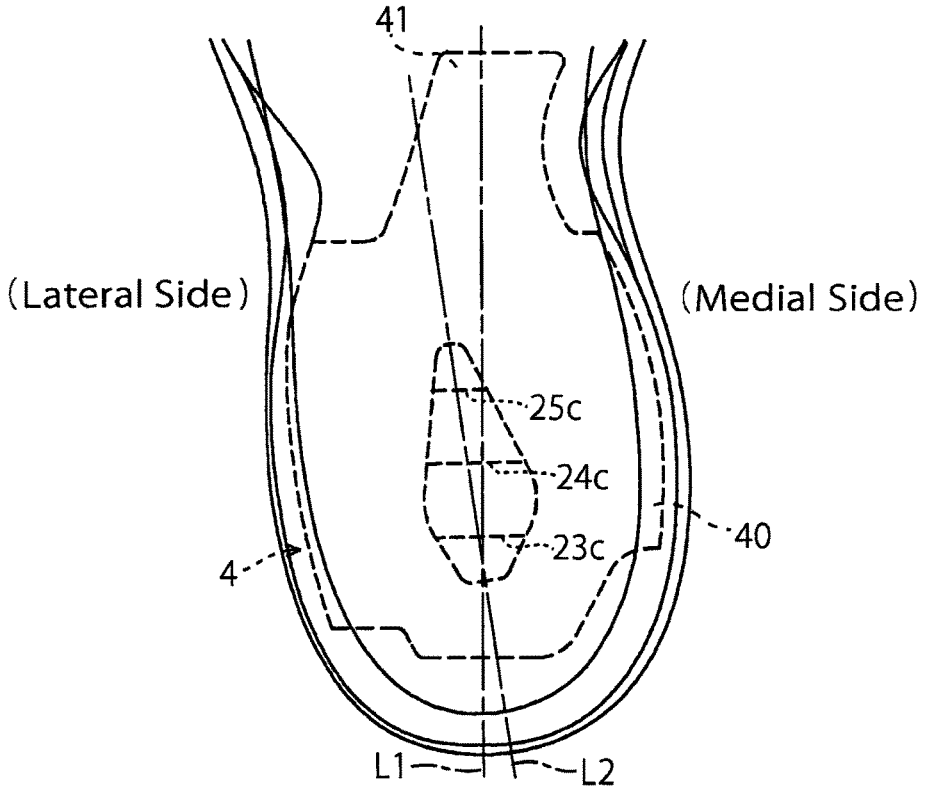
FIG. 26 is a schematic view of the heel region of FIG. 1.

FIGS. 26 to 29 illustrate the seventh alternative embodiment of the present invention. FIG. 26 is a schematic view of the heel region H in FIG. 1 of the above-mentioned embodiment. In the drawing, each of the trough lines 23*c*, 24*c*, 25*c* of the recesses 23, 24, 25 on the lower surface 2B of the upper midsole 2 is disposed along the width direction.

Figure 27:
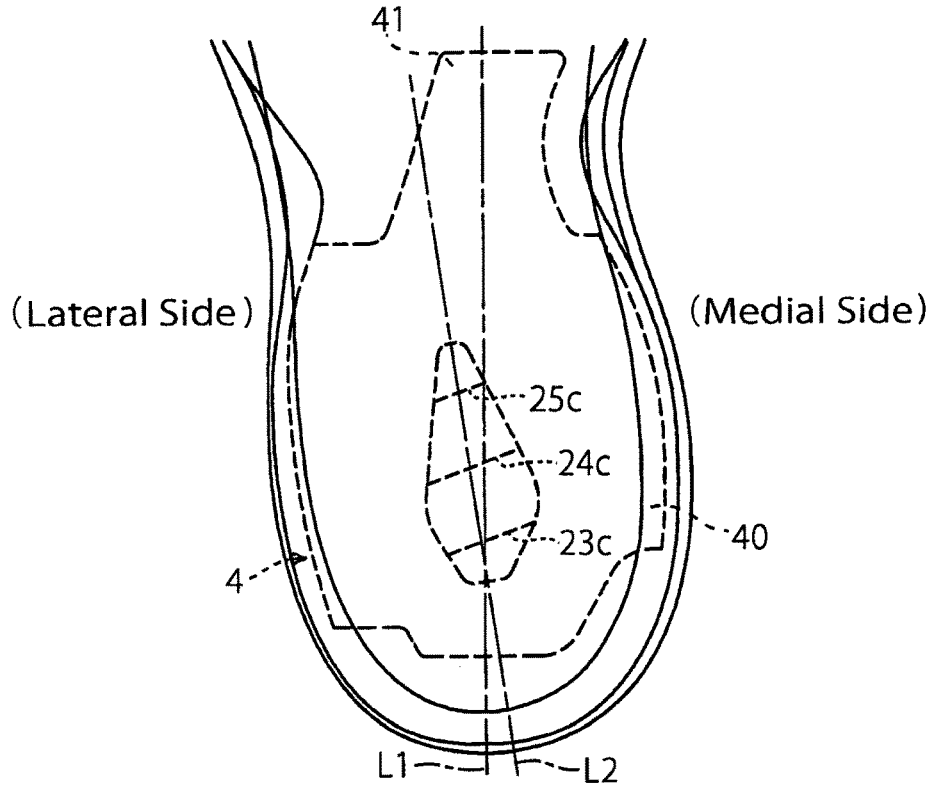
FIG. 27 illustrates a seventh variant of the present invention, which corresponds to FIG. 26.
Figure 28:
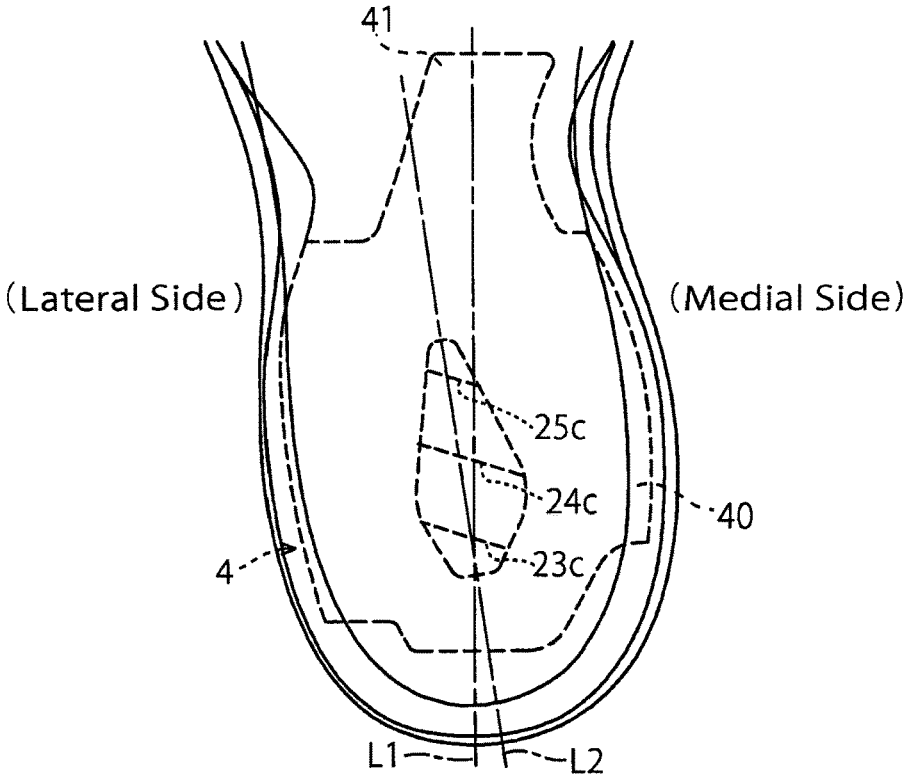
FIG. 28 illustrates a seventh variant of the present invention, which corresponds to FIG. 26.
Figure 29:
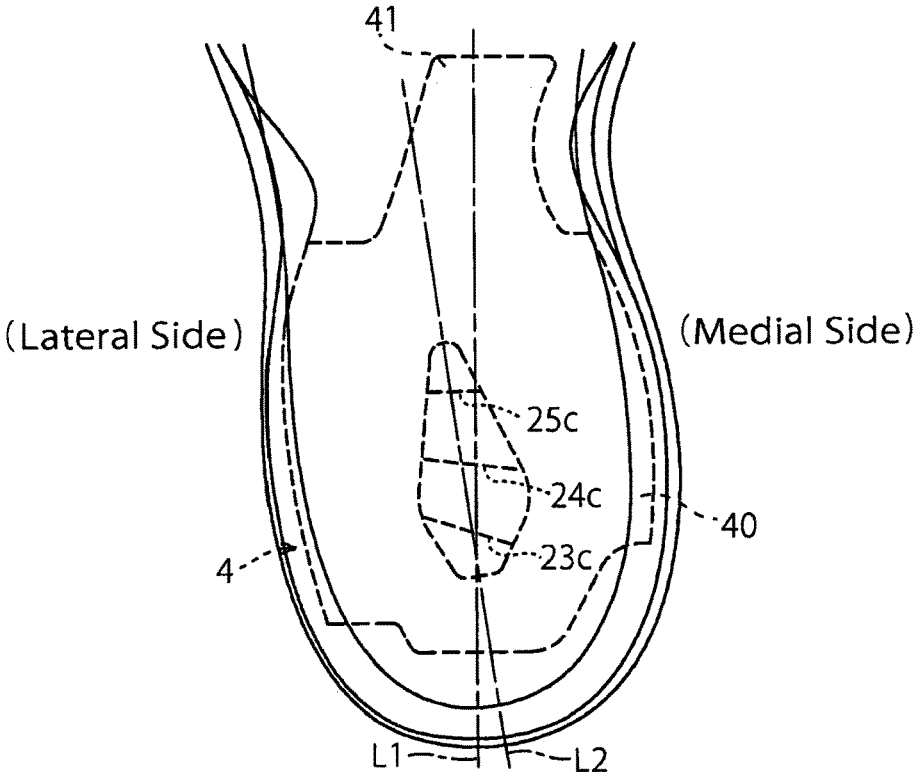
FIG. 29 illustrates a seventh variant of the present invention, which corresponds to FIG. 26.

On the other hand, in FIG. 27, the trough lines 23*c*, 24*c*, 25*c* are disposed diagonally relative to the width direction (i.e. inclined upward right in the drawing) and parallel to each other. In FIG. 28, the trough lines 23*c*, 24*c*, 25*c* are disposed diagonally relative to the width direction (i.e. inclined upward left in the drawing, contrary to those in FIG. 27) and parallel to each other. In FIG. 29, the trough lines 23*c*, 24, 25*c* are disposed diagonally relative to the width direction (i.e. inclined upward left in the drawing) but not parallel to each other and respective inclinations are different.

In the case of FIG. 26, since load transfer at the heel region H occurs along the longitudinal centerline L1 perpendicular to the trough lines 23*c*, 24*c*, 25*c*, load is guided along the longitudinal direction and the heel region H bends along the width direction. On the other hand, in the case of FIG. 27, since load transfer at the heel region H occurs along the direction perpendicular to the trough lines 23*c*, 24*c*, 25*c* (thus the direction slightly more inclined toward the lateral side than the heel centerline L2), load is guided toward the lateral side and the heel region H bends along the above-mentioned direction. In the case of FIG. 28, since load transfer at the heel region H occurs along the direction perpendicular to the trough lines 23*c*, 24*c*, 25*c* (thus the direction slightly more inclined toward the medial side than the longitudinal centerline L1), load is guided toward the medial side and the heel region H bends along the above-mentioned direction. In the case of FIG. 29, since load transfer at the heel region H occurs along the respective directions perpendicular to the respective trough lines 23*c*, 24*c*, 25*c* of different inclination, load is guided from the medial side gradually toward the longitudinal direction and the heel region H is caused to be bent along the above-mentioned respective directions with the bending direction changed.

Eighth Alternative Embodiment

In the above-mentioned embodiment, an example was shown in which each of the wavy shapes of the upper and lower midsoles 2, 3 extends from the heel region H through the midfoot region M to the forefoot region F of the midsole structure 1, but in the midsole structure of the present invention each of the wavy shapes of the upper and lower midsoles 2, 3 has only to be provided at least at the heel region H.

Other Application

In the above-mentioned embodiments and alternative embodiments, an example was shown in which the midsole structure of the present invention was applied to the running shoe, but the application of the present invention was not limited to such an example. The present invention also has application to walking shoes or other sports shoes.

As mentioned above, the present invention is useful for a midsole structure for a shoe that can not only secure landing stability of the heel region but also further improve cushioning properties of the heel central portion and control bending direction.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A midsole structure for a shoe comprising:

an upper midsole disposed on an upper side of said midsole structure at a heel region that corresponds to a heel portion of a foot of a wearer of the shoe;

a lower midsole disposed below said upper midsole; and a wavy sheet interposed between said upper midsole and said lower midsole;

wherein said wavy sheet has a wavy shape with ridge lines and trough lines at least either at a sheet medial side portion or at a sheet lateral side portion of said wavy sheet, and a planar shape area at a sheet central portion of said wavy sheet, wherein said sheet central portion of said wavy sheet is disposed at a heel central region of said midsole structure, and wherein said planar shape area extends across a plurality of said ridge and trough lines at said sheet medial side portion or at said sheet lateral side portion in a substantially longitudinal direction of said midsole structure; and wherein a lower surface of said upper midsole and an upper surface of said lower midsole respectively have a wavy shape that corresponds to said wavy shape of said wavy sheet at least either at a midsole medial side portion or at a midsole lateral side portion, said lower surface of said upper midsole and said upper surface of said lower midsole respectively have a planar shape area that corresponds to said planar shape area of said wavy sheet at said heel central region of said midsole structure, and at least either said lower surface of said upper midsole or said upper surface of said lower midsole has a plurality of recesses disposed along the substantially longitudinal direction at said heel central region of said midsole structure.

2. The midsole structure according to claim 1, wherein at least either said lower surface of said upper midsole or said upper surface of said lower midsole has a wavy shape formed of said plurality of recesses at said heel central region of said midsole structure.

3. The midsole structure according to claim 1, wherein either only said lower surface of said upper midsole or only said upper surface of said lower midsole has a wavy shape formed of said plurality of recesses at said heel central region of said midsole structure.

4. The midsole structure according to claim 1, wherein both said lower surface of said upper midsole and said upper surface of said lower midsole respectively have a wavy shape formed of said plurality of recesses at said heel central region of said midsole structure.

5. The midsole structure according to claim 4, wherein said plurality of recesses of said lower surface of said upper midsole at said heel central region and said plurality of recesses of said upper surface of said lower midsole at said heel central region are aligned with one another in an up-down direction.

6. The midsole structure according to claim 4, wherein said plurality of recesses of said lower surface of said upper midsole at said heel central region and said plurality of recesses of said upper surface of said lower midsole at said heel central region are not aligned with one another in an up-down direction, and are offset from one another in the substantially longitudinal direction, and wherein said wavy shape of said lower surface of said upper midsole and of said upper surface of said lower midsole is formed by said plurality of recesses of both said upper midsole and said lower midsole.

7. The midsole structure according to claim 1, wherein at least either said lower surface of said upper midsole or said upper surface of said lower midsole has a trough line that extends in a substantially widthwise direction of said midsole structure at a bottom portion of said plurality of recesses.

8. The midsole structure according to claim 1, wherein at least either said lower surface of said upper midsole or said upper surface of said lower midsole has a trough line that extends inclined relative to a substantially widthwise direction of said midsole structure at a bottom portion of said plurality of recesses.

9. The midsole structure according to claim 1, wherein said wavy sheet has an opening portion formed thereinto at said sheet central portion.

10. The midsole structure according to claim 1, wherein said planar shape area of said wavy sheet is a two-dimensional flat planar area that has a flat planar shape extending in said substantially longitudinal direction and in a substantially widthwise direction of said midsole structure at said sheet central portion.

11. The midsole structure according to claim 1, wherein said ridge lines and said trough lines of said wavy shape of said wavy sheet respectively extend in a substantially widthwise direction of said midsole structure.

12. The midsole structure according to claim 1, wherein said planar shape area of said wavy sheet does not have a wavy shape.

13. The midsole structure according to claim 1, wherein said planar shape area of said wavy sheet does not have ridge and trough lines.

14. The midsole structure according to claim 1, wherein said ridge lines and said trough lines of said wavy shape of said wavy sheet are discontinuous in a substantially widthwise direction and are interrupted and non-existent at said planar shape area of said wavy sheet.

15. The midsole structure according to claim 1, wherein said planar shape area of said wavy sheet is displaced forwardly away from a rear end of a heel of said midsole structure.

16. The midsole structure according to claim 1, wherein a rear end of said wavy sheet is displaced forwardly away from a rear end of a heel of said midsole structure.

17. The midsole structure according to claim 1, wherein said planar shape area of said wavy sheet is displaced transversely inwardly away from a medial side edge and a lateral side edge of said midsole structure.

18. The midsole structure according to claim 1, wherein a surface of said planar shape area of said wavy sheet extends locally substantially parallel to an upper surface of said upper midsole.

* * * * *